United States Patent [19]

Sukle

[11] 4,182,104

[45] Jan. 8, 1980

[54] DOUBLE TWIST WIRE BUNCHER

[75] Inventor: Vincent F. Sukle, Oakwood Village, Ohio

[73] Assignee: United States Steel Corporation, Pittsburgh, Pa.

[21] Appl. No.: 941,335

[22] Filed: Sep. 11, 1978

[51] Int. Cl.[2] ..... D07B 3/12; D01H 7/86

[52] U.S. Cl. ..... 57/58.52; 57/58.86

[58] Field of Search ..... 57/58.52–58.57, 57/58.83, 58.86, 58.7

[56] References Cited

U.S. PATENT DOCUMENTS

| | | | |
|---|---|---|---|
| 1,983,413 | 12/1934 | Spagnolo | 57/58.54 |
| 2,331,648 | 10/1943 | Berggren et al. | 57/58.57 |
| 3,791,127 | 2/1974 | Wesson | 57/58.52 |
| 3,791,131 | 2/1974 | Scott et al. | 57/58.52 X |
| 3,867,809 | 2/1975 | Holbrook | 57/58.52 |
| 3,949,543 | 4/1976 | Bittman | 57/58.52 X |

*Primary Examiner*—John Petrakes
*Attorney, Agent, or Firm*—Forest C. Sexton

[57] ABSTRACT

An improved double twist wire bunching machine has a reel consisting of at least one disk on which a plurality of wire spools can be mounted with parallel horizontal axes. An improved brake tensioning system includes a brake shoe assembly associated with each spool, a tension spring connected to each brake shoe assembly, an actuator ring rotationally mounted on the creel and engaging the ends of each tension spring and a contacting means associated with one wire spool sensitive to the amount of wire on the spool such that as the amount of wire on the spool is decreasing, the contacting means causes the actuator ring to rotate through a proportionate angle decreasing the tension in the tension springs to thereby proportionally and uniformly decrease the brake tension on the spools and thereby maintain a constant tension in the wires being bunched.

8 Claims, 5 Drawing Figures

DOUBLE TWIST WIRE BUNCHER

BACKGROUND OF THE INVENTION

Wire stand forming machines are well known in the prior art for use in twisting or stranding two or more individual strands of wire together to form wire cord or other stranded wire products. One such machine commonly used in producing small sized stranded wire products, referred to as a "wire buncher", accepts two or more individual wire spools mounted onto a stationary creel between a pair of rotating discs or arms, each having a pulley, or "flying sheave" at its periphery. The individual strands of wire are pulled through an orifice at the axis of one rotating arm and radially outward over the flying sheave thereon, while the flying sheave rotates around the orifice. Each such rotation serves to put one full twist into the wire bunch. The wire bunch then passes back to the other rotating flying sheave while revolving around the creel. The bunched wire then is pulled radially inward and through another orifice at the axis of rotation, and axially outward onto a take-up spool. This rotation about the second orifice serves to put another twist into the bunched wire before it is reeled onto the take-up spool.

Although such wire bunching machines have worked satisfactorily to produce many stranded wire products, some customers are demanding closer tolerances on quality of the product. For example, steel wire cords used in the production of steel belted tires must be produced to very close tension requirements. Because of the way the several individual spools of wire on a wire buncher are mounted, it is not always possible to assure that the individual strands of wire are subject to the same tension with respect to each other during unwinding. In addition, it is not possible to maintain a constant tension in an individual strand of wire from commencement to finishing of the unwinding. Since most wire bunching machines utilize some sort of brake system which applies a constant pressure on the wire spools to effect tension in the wire, it is clear that the resulting wire tension will increase as a spool progresses from full to near empty. That is to say, the unwinding torque is greatest when the spool is full and decreases as the amount of wire removing on the spool decreases. This is due, of course, on the decreasing moment, i.e. decreasing radius from the axis of rotation to the point of tangency where the wire is pulled from the reel. With the diminishing torque there is a corresponding increase in tension in the wire. Hence, in applying a constant frictional pressure on the wire spools, the bunching tension increases progressively as the wire spools progress from full to near empty.

Various attempts to overcome the above problems have resulted in spool mounting arrangements and brake systems which have substantially enhanced the hardware mounted on the creel. This in turn has necessitated a wider spacing between the flying sheaves and/or a greater radius of rotation thereof, either of which is most detrimental. Specifically, increasing the radius of rotation on the flying sheave spacing necessitates a slower operating speed. Firstly, the centrifugal forces on the length of stranded wire spaced between the flying sheaves increases as the cube of the distance between the flying sheaves. Secondly, these centrifugal forces increases proportionally with increases in the radius of rotation of the flying sheaves. Accordingly, maximum operating speed can be effected by minimizing the radius of rotation and particularly minimizing the flying sheave spacing.

SUMMARY OF THE INVENTION

This invention is predicated upon my conception and development of a new and improved double twist wire buncher having a unique wire spool brake system which applies a uniform brake pressure to each wire spool which progressively decreases as the spools progress from full to empty. This of course serves to provide a constant tension in each individual wire strand throughout the wire bunching operation. A further unique feature of this inventive brake system is that the brake hardware, in combination with a unique spool mounting system, require a minimum amount of space which thereby allows a minimum flying sheave spacing and radius of rotation to allow high speed operation.

Accordingly, an object of this invention is to provide a new and improved high-speed double-twist wire buncher which will provide a uniform and constant tension in the individual wire strands being joined throughout the wire bunching operation.

Another object of this invention is to provide a new and improved brake system on a double-twist wire buncher which will provide a progresively decreasing brake pressure on the individual wire spools as the spools progress from full to empty, to thereby effect a uniform and constant tension in the individual wire strands throughout the operation.

A further object of this invention is to provide an improved brake system on a double-twist wire buncher wherein the spool mounting, braking and guiding hardware makes optimum use of space to minimize the span between flying sheaves as well as the radius of sheave rotation.

DESCRIPTION OF THE PREFERRED EMBODIMENT

Figure 1:
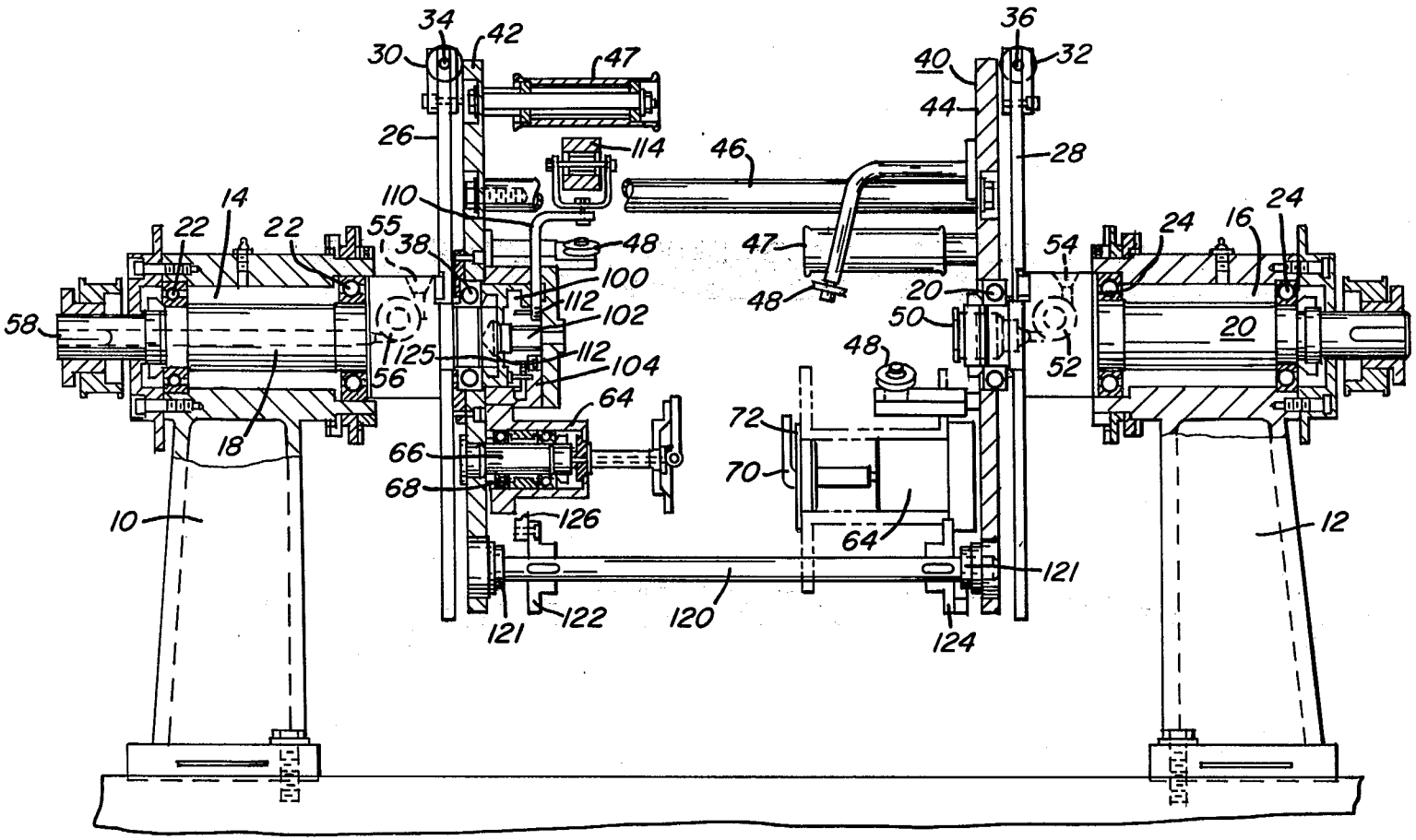
FIG. 1 is an elevational view, in partial section, of the wire stranding apparatus built in accordance with this invention.

With reference to the drawings, and particularly FIG. 1, the wire stranding apparatus of this invention is rotatably supported between a pair of opposed upright stands 10 and 12, as is typical of most prior art wire bunchers. Cylindrical housings 14 and 16 at the top of stands 10 and 12 respectively rotatably support horizontally disposed shafts 18 and 20 respectively on a common axis through intermediate bearings 22 and 24 respectively. Flying arms 26 and 28 are rigidly secured to shafts 18 and 20 respectively, and are provided with flying sheaves 30 and 32 respectively, at the outer edge thereof, freely rotatable on flying pins 34 and 36 respectively. Additional bearings 38 and 39 are mounted on the extreme inner ends of shafts 18 and 20 respectively for supporting the creel structure 40, which basically comprises two upright opposed disks 42 and 44 rigidly secured to each other by two rods 46. While creel 40 is free to rotate on bearings 38 and 39, the creel 40 is essentially a non-rotating member utilized to hold the individual wire spools and tensioning mechanism between the flying arms 26 and 28.

As is typical of most double twist wire bunchers in the prior art, the individual wire spools are mounted on the creel, and the individual wires simultaneously feed therefrom around an adjacent guide roller 47 over a plurality of sheaves 48 into an orifice 50 at the inside axis of shaft 20. This serves to bunch the wires together in a parallel relationship. The bunched wires then pass over sheave 52 and radially outward through opening 54 to flying sheave 32. The bunched wires then pass horizontally back, from right to left over flying sheave 30. From sheave 30, the bunched wires pass radially inward and into shaft 18 through opening 55 and partially around sheave 56. The bunched wires then exit from shaft 18 through opening 58 and then wound onto a take-up spool (not shown). During this entire movement of wire, shafts 18 and 20 rotate in unison so that flying sheaves 30 and 32 revolve in unison about the axis of the shafts, and accordingly, as the bunched wires pass horizontally from flying sheave 32 to flying sheave 30, they are at the same time rotating about creel 40. Each such revolution serves to put two twists into the bunched wires.

Figure 2:
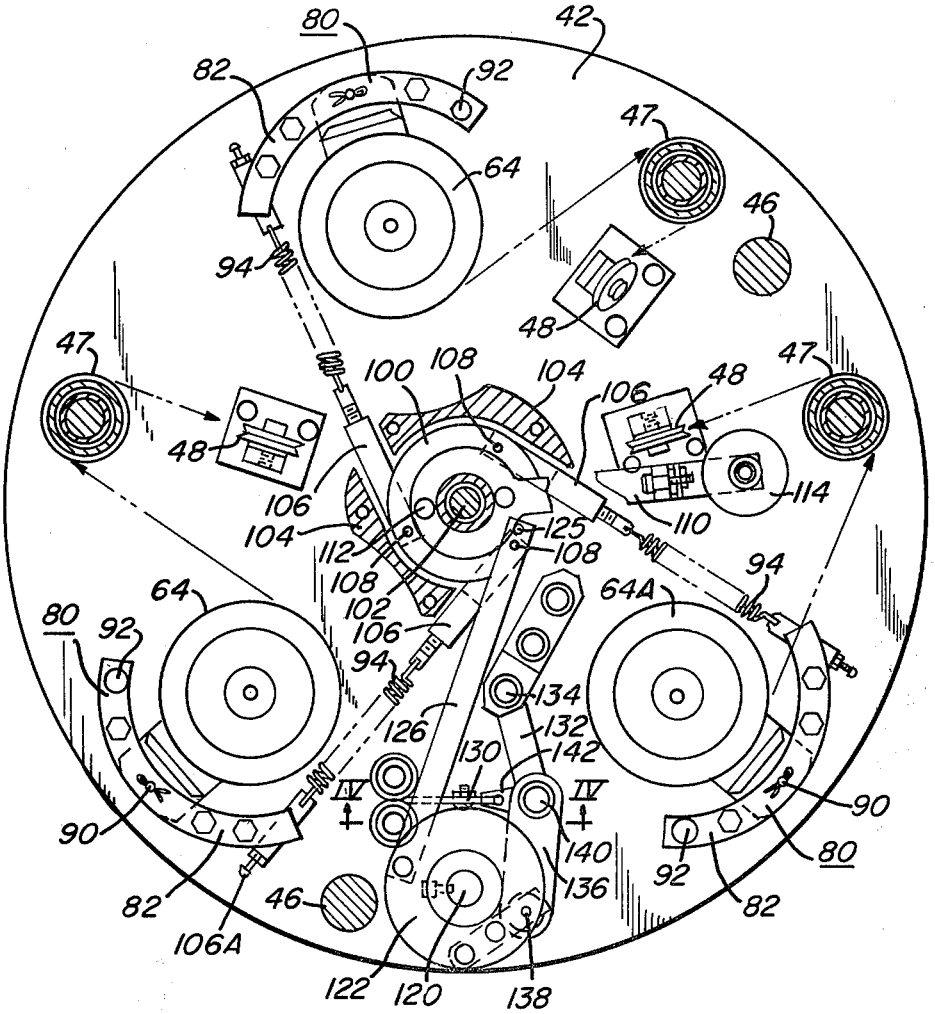
FIG. 2 is an inside side view of the left creel taken on lines 2—2 of FIG. 1.
Figure 3:
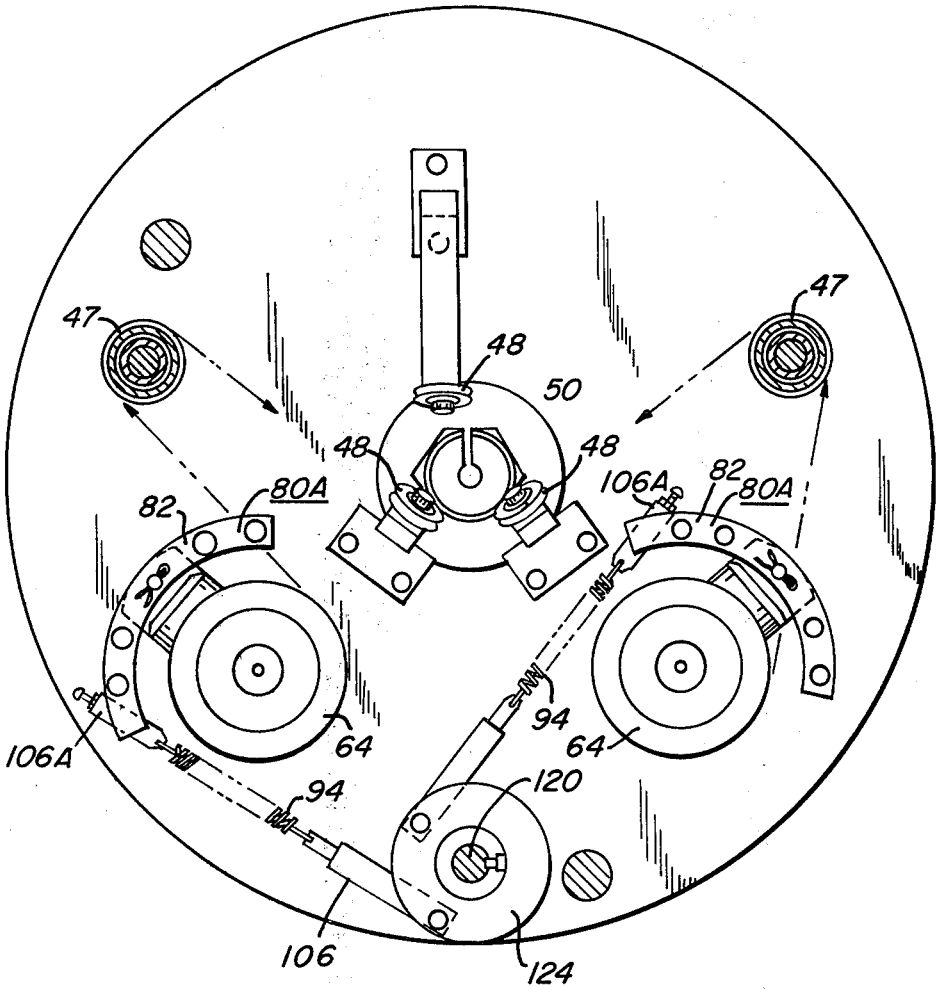
FIG. 3 is an inside side view of the right creel taken on lines 3—3 of FIG. 1.
Figure 4:
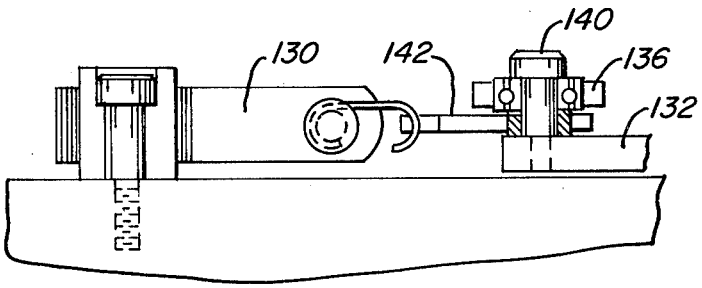
FIG. 4 is a partial sectional view of the negator spring assembly taken on lines 4—4 of FIG. 2.

The crux of this invention resides in the unique wire tensioning brake system as is best illustrated in FIG. 2, and in the unique creel combined therewith as best illustrated in FIGS. 1, 2 and 3. With reference to FIGS. 1, 2 and 3, the inventive creel basically consists of two opposed disks 42 and 44 having a common horizontal axis and rigidly spaced from each other by rods 46. At least two rods 46, as shown, should be provided for good stability. Disks 42 and 44 are mounted inside flying arms 26 and 28 on bearings 38 and 37 on shafts 18 and 20, and by virtue thereof the entire creel assembly is free to oscillate thereon. Nevertheless, the creel assembly is essentially a nonrotating member.

A plurality of hubs 64, having horizontal axes are rotatably secured to the inside faces of disks 42 and 44 over hub pins 66 and bearings 68. As shown, three hubs 64 are attached to disk 42 while two such hubs 64 are attached to disk 44. This particular arrangement is ideal for stranding five wires, other hub arrangements and other numbers thereof could be providing depending upon the number of wires to be stranded. Each hub 64 is provided with a locking mechanism 70 for locking a spool of wire 72 (shown with a broken line in FIG. 1 only ) onto each hub 64. A plurality of sheaves 48 are strategically mounted on one or the other disks 42 and 44 to guide the individual strands of wire into orifice 50 at equal angles to the axis.

Figure 5:
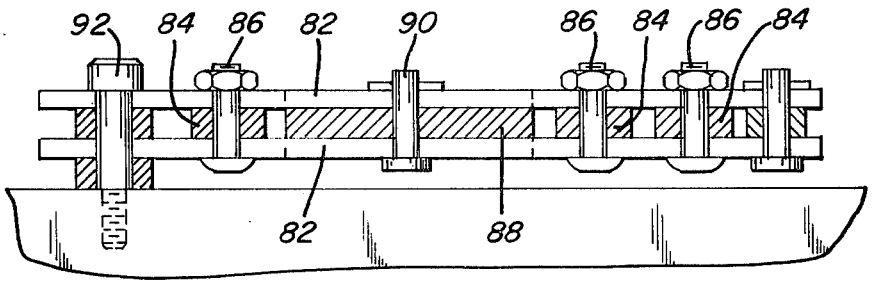
FIG. 5 is a sectional view of the brake shoe assembly taken on lines 5—5 of FIG. 2.

The unique brake tensioning system of this invention is best illustrated in FIG. 2, and comprises one brake shoe assembly 80 for each hub 64, consisting of two arcuate plates 82 (FIG. 5), spaced apart by spacers 84 and nuts and bolts 86 and having a friction brake 88 pivotally secured therebetween by pin 90. The brake shoe assembly 80 is pivotally secured at bolt 92 such that friction brake 88 can be made to press against the flange of hub 64 by the inward pulling force of spring 94.

An actuator ring 100 is rotatably mounted at the inside axis of disk 42 over shaft 102 and held in place by casting 104 bolted to the inside face of disk 42. Tension adjustors 106 (not shown on FIG. 1) are pivotally attached at one end to actuator ring 100 by pins 108, with the other end thereof engaging springs 94. While the adjustors 106 are pivotal extend somewhat tangently away from actuator ring 100, a lever arm 110 is rigidly secured to actuator ring 100 by bolts 112 and extends radially outward. A roller 114 is rotatably secured to the outer end of lever arm 110 and is adapted to selectively engage the outer surface of wire wound onto a spool mounted on hub 64A by pivoting lever arm 110 downward (clockwise) as shown in FIG. 2). This pivotal action is accompanied by a corresponding partial rotation of actuator ring 100 and tangently outward movement of adjustors 106. In operation, the tension in springs 94 pulling on adjustors 106 will effectively rotate actuator ring 100 and pivot lever arm 110 to bias roller 114 against the outer surface of spooled wire on hub 64A (FIG. 2). As the spool of wire progresses from full to empty, this biasing action causes a gradual but continuous downward motion of roller 114 and lever arm 110 and a corresponding clockwise rotation (as viewed in FIG. 2) of actuator ring 100, a slight outward motion of adjustors 106 and accordingly a decrease in the tension in springs 94 which is accompanied by a gradual decrease in brake pressure applied to hubs 64.

As for the hubs mounted on the other creel disk 44, it is obvious that the above-described apparatus could be duplicated against the inside surface of disk 44. In the preferred embodiment of this invention however such a complete duplication need not be made. In the embodiment shown the same actuator ring 100 effectively adjusts brake tension on those hubs 64 mounted on disk 44. To this end, a transfer shaft 120 is provided which extends between disks 42 and 44 at the lower edges thereof and is rotatably mounted to bearings 121. A first and second transfer ring 122 and 124 are rigidly keyed to transfer shaft 120 adjacent to disks 42 and 44 respectively. One end of push rod 126 is pivotably pinned to actuator ring 100 by pin 125 while the other end is pivotally mounted or pinned to transfer ring 122. Brake shoe assemblies 80A, tension springs 94A and tension adjusters 106A, substantially as described above are provided against the inside surface to disk 44, but instead of being attached to an actuator ring as the axis, are comparably attached to transfer ring 122. Hence the slow rotating motion are duplicated in transfer ring 122 by the action of push rod 126 on transfer ring 122 and transfer shaft 120 to identically adjust the brake pressure applied to brake shoes 80A.

Although the apparatus as described above is sufficient to appreciate the full advantages of this invention, I have preferred to further add a means for minimizing or dampening the pressure applied to the spooled wire by roller 14. Particularly when bunching fine plated wire, any moderately heavy pressure on the wire by roller 114, particularly in this embodiment where five tension springs 94 are cooperating in unison, could be sufficient to mar or otherwise impair surface quality. Accordingly, to minimize pressure by roller 114, a negator spring 130 is provided to partially counteract the forces on actuator ring 100 caused by tension springs 94. The (constant pressure) negator spring 130 is bolted to the inside face of disk 42 adjacent to transfer ring 122. A first link member 132 is provided with its upper end pivotally attached to disk 42 by pin 134. A second link member 136 is pivotally secured to the outer edge of transfer ring 122 by pin 138. The free ends of links 132 and 136 are joined together by pin 140. A pivotal connector 142 is also provided at pin 140 which engages the end of negator spring 130 in tension. Hence negator spring 130, pulling on pin 140 causes a counter-clockwise force (as viewed in FIG. 2) on transfer ring 122, which in turn applies a pushing force on push rod 126, a counter-clockwise force on actuator ring 100 and thus a lifting force on lever arm 110. This serves to reduce the pressure of roller 114 on the wire surface without affecting the brake shoe pressure on the hubs 64 caused by tension springs 94.

To operate the above described wire bunching machine, a spool of wire is mounted on each of the five hubs 64 and locked in place by the locking mechanisms 70. Each spool should be of the same size and the amount of wire on each spool should be approximately the same. The various strands of wire are fed over the appropriate guide rollers 47 and creel sheaves 48, through orifice 50, around sheave 52 and out opening 54. The combined wires are then fed over flying sheaves 32 then 30 down into opening 55, around sheave 56 outward through opening 58 and onto a take-up reel (not shown). The wire paths as described above are shown in the drawings as broken lines with arrowheads denoting the direction of motion. Tension springs 94 are then allowed to bias roller 114 against the wire wound onto the reel on hub 64A. The machine can then be started and operated by activating on electric motor (not shown) which activates the take-up reel (not shown) to pull the wires as indicated above, while the flying sheaves 30 and 32 rotate around the creel to twist the wires together into a single strand. The pressure on hubs 64 applied by break shoes 80 serves to impose the desired uniform tension in each strand of wire. The tension in all wire strands should be uniform and preadjusted by proper adjustment of the tension in tension springs 94 by adjustment of adjusters 106A. As the wire is bunched, the amount of wire remaining on the spools decreases, and hence the torque acting on the spools decreases progressively. By this invention however, the tension in the wire does not increase because the brake pressure on hubs 64 is progressively decreased as previously described by the gradual downward movement of roller 14 and the gradual rotation of actuator ring 100 to gradually decrease the tension in springs 94.

As is known in the prior art, the numer of twists per unit length of the stranded wires is a function of the speed of travel of the wire and the revolutions per minute of the flying disks or arms 26 and 28, each of which imparts one twist per revolution.

From the foregoing description it can readily be seen that numerous modifications could be made to the wire bunching machine without departing from the spirit of the invention. For example, since the creel is not a rotating member, disks 42 and 44 need not be circular in shape but may be vertically disposed plates of any desired configuration provided flying arms 26 and 28 can still rotate therearound. Obviously, more than or less than seven strands of wire can be bunched by reducing or adding hubs 64. If four or fewer wires are to be bunched, then one disk 42 may suffice and thereby eliminate the need for transfer shaft 120 as well as disk 44. In addition, other means could be provided to dampen the tension on lever arm 110.

I claim:

1. In a double-twist wire bunching machine having a creel onto which a plurality of individual wire spools are rotationally mounted, an orifice through said creel through which all the wires are drawn and gathered, a pair of flying sheaves adapted to rotate in unison around said creel while the gathered wire strands are drawn thereover, the improvement comprising a creel consisting of at least one vertically disposed plate, a plurality of spaced and independent hubs mounted on said plate each adapted to receive an individual wire spool such that the spool axes are horizontal, at least one brake shoe assembly adjacent to each hub adapted to apply a brake pressure onto the associated hub, sensing means associated with one of said hubs for sensing the amount of wire on a spool mounted on said hub, and tensioning means responsive to said sensing means to uniformly apply the brake pressure to each hub in proportion to the amount of wire on said spool such that the brake pressure on the hubs is gradually and uniformly reduced as the amount of wire on said spool is reduced.

2. A double-twist wire bunching machine according to claim 1 in which the creel consists of two spaced, parallel and vertically disposed plates, each of which has a portion of said hubs mounted on the inside faces thereof.

3. A double-twist wire bunching machine according to claim 2 in which said plates are a pair of discs having a common axis.

4. A double-twist wire bunching machine according to claims 1, 2 or 3 wherein said tensioning means consists of a tension spring connected to each brake shoe assembly such that the brake pressure applied by each brake shoe assembly is in proportion to the uniform tension in said tension springs, a rotatable actuator ring engaging the other end of each tension spring, and a sensing means adapted to sense the amount of wire on at least one of said wire spools mounted on a hub and gradually rotate said actuator ring to gradually reduce the tension in said tension springs as the amount of wire on said spool is gradually reduced.

5. A double-twist wire bunching machine according to claim 4 in which said sensing means consists of a lever arm, one end of which is secured to said actuator ring and the other end having a roller adapted to be biased against the wire windings on one of said spools by the tension in said tension springs.

6. A double-twist wire bunching machine according to claim 5 further including a tension dampening means so that the pressure of the roller biased against the wire winding is minimized so that it will not damage the wire.

7. A double-twist wire bunching machine according to claim 6 in which said dampening means consists of a negator spring adapted to reduce the biasing forces said tension springs imposed on said roller.

8. In a double-twist wire bunching machine having a creel onto which a plurality of individual wire spools are rotationally mounted, an orifice through said creel through which all the wires are drawn and gathered, a pair of flying sheaves adapted to rotate in unison around said creel while the gathered wire strands are drawn thereover, the improvement comprising providing at least one disk in the creel having a horizontal axis, a plurality of hubs mounted on said disk adapted to receive the individual wire spools such that the spool axes are horizontal, at least one brake shoe assembly adjacent to each hub adapted to apply a brake pressure onto the associated hub, a tension spring connected to each brake shoe assembly such that the brake pressure applied by each such assembly is in proportion to the tension in the tension spring, an actuator member rotatably mounted on said creel and engaging each said tension spring such that rotation of said actuator member will uniformly vary the tension in each tension spring in proportion to the amount of rotation, and a contacting means associated with at least one of said hubs for engaging the outer surface of wire wound on a spool mounted on said hub while in coil form and while it is being unwound such that said contactor means is sensitive to the gradual decrease in the diameter of wire remaining on said spool, said actuator member being responsive to said contacting means to gradually rotate in response to the gradual decrease in the diameter of wire remaining on said spool to thereby proportionally and uniformly decrease the tension in each said tension spring, and accordingly gradually and uniformly decrease the brake pressure applied to each hub.

* * * * *